United States Patent [19]

Miao

[11] Patent Number: 4,907,320

[45] Date of Patent: Mar. 13, 1990

[54] DETACHABLE DROP-OFF-PROOF BUTTON

[76] Inventor: Ting Miao, Flat No. 24, 741 Julu Lu, Shanghai, China

[21] Appl. No.: 126,580

[22] Filed: Nov. 30, 1987

[51] Int. Cl.[4] ..... A44B 1/18

[52] U.S. Cl. ..... 24/101 R; 24/90 A; 24/113 MP

[58] Field of Search ..... 24/101 R, 90 A, 94, 24/96, 103, 104, 113 MP, 102 P, 113 R

[56] References Cited

U.S. PATENT DOCUMENTS

| | | | |
|---|---|---|---|
| 159,106 | 1/1875 | Mason et al. | 24/101 R |
| 336,064 | 2/1886 | Palmer | 24/113 MP |
| 539,225 | 5/1895 | Hyde Jr. | 24/95 |
| 570,371 | 10/1896 | Brown | 24/101 R |
| 582,475 | 5/1897 | Kempshall | 24/113 MP |
| 749,856 | 1/1904 | Fogel et al. | 24/101 R |
| 757,978 | 4/1904 | Strang | 24/101 R |
| 861,710 | 7/1907 | Crecelius | 24/102 P |
| 1,268,044 | 5/1918 | Nast | 24/101 R |
| 1,315,902 | 9/1919 | Barger | 24/101 R |
| 1,445,119 | 2/1923 | White | 24/101 R |
| 1,741,027 | 12/1929 | King | 24/101 R |
| 2,026,380 | 12/1935 | Feuerstein | 24/101 R |
| 2,214,030 | 9/1940 | Pereles | 24/113 MP |
| 2,397,856 | 4/1946 | Hagerty | 24/102 P |
| 3,720,982 | 3/1973 | Myers et al. | |
| 3,725,980 | 4/1973 | Burgio | |
| 3,879,808 | 4/1975 | Alberts | |
| 3,925,860 | 12/1975 | Furuya | |
| 4,035,874 | 7/1977 | Liljendahl | |
| 4,043,006 | 8/1977 | Williams et al. | |
| 4,283,815 | 8/1981 | Henshaw | 24/90 A |
| 4,471,510 | 9/1984 | DeRosa | |
| 4,539,735 | 9/1985 | Kasai | |

FOREIGN PATENT DOCUMENTS

| | | | |
|---|---|---|---|
| 85105295 | 7/1985 | China | |
| 85202806 | 7/1985 | China | |
| 85204825 | 11/1985 | China | |
| 86200787 | 1/1986 | China | |
| 86202950 | 5/1986 | China | |
| 86203963 | 6/1986 | China | |
| 87202764 | 3/1987 | China | |
| 755604 | 11/1933 | France | 24/90 A |
| 1059590 | 1/1954 | France | 24/113 MP |
| 4126 | 1/1901 | United Kingdom | 24/101 R |
| 24671 | 6/1985 | United Kingdom | 24/101 R |

*Primary Examiner*—Victor N. Sakran

*Attorney, Agent, or Firm*—Brumbaugh, Graves, Donohue & Raymond

[57] ABSTRACT

A drop-off-proof button, which is not thread sewn to the clothing to which it is attached, and is capable of staying on to the clothing permanently without dropping off and of being attached to or detached from the clothing at will. It comprises one main button head, one auxiliary button head and one connecting stud. To the main button head, a decorative piece can be fixed through appropriate means. The main button head, the auxiliary button head and the connecting link can be made in one integral piece, or separately into independent pieces. The connecting link can be made integral with the main button head or the auxiliary button head, to which the auxiliary button head or the main button head can then be fixed through appropriate means respectively. In attaching the button to the clothing, the auxiliary button head is buttoned into a matching buttonhole on one flap of the clothing. Thus done, the clothing is now ready to be buttoned up in the conventional way by buttoning the main button head into the other matching buttonhole on the other flap of the clothing. This drop-off-proof button has the advantage of versatility, being attachable to or detachable from the clothing at will, facilitating the ironing and washing of the clothing, and the changing of buttons to keep abreast with current fashion on buttoning. Not being attached to the clothing by thread, which is mechanically weak, the drop-off-proof button will stay on the clothing until detached.

10 Claims, 1 Drawing Sheet

DETACHABLE DROP-OFF-PROOF BUTTON

BACKGROUND OF THE INVENTION

This invention relates generally to button fasteners for securing articles, such as clothing, by passage through a buttonhole or loop, and more particularly to a button fastener which is not sewn to the article but is capable of being readily attached to or detached from the article. Since sewing thread is not used in attaching the button of the present invention to an article, it is not subject to dropping off the article as a result of breakage of the sewing thread. Such a button can stay on permanently if not detached and is virtually drop-off-proof.

It is well-known that conventional button fasteners are generally sewn to articles, such as clothing, with thread. Sewing a button to the article is usually time consuming. Furthermore, after long usage the thread which attaches the button to the article is apt to become frayed and eventually break, causing the button to drop off and thus creating a nuisance. There is another type of button in the market which is riveted to the article and is also drop-off-proof. However, since riveting is an irreversible process, once the button is riveted onto the article, it can never be removed without damaging the article to which the button is attached. Where the article is clothing, it is desirable to remove the buttons prior to ironing of such clothing, since the buttons tend to get in the way of the moving iron and make the ironing more difficult. Moreover, it is desirable to remove buttons from clothing prior to machine washing of such clothing, since the buttons tend to scratch and otherwise damage the inner surface of the washing machine as well as increase the wear and tear on the clothing proper.

SUMMARY OF THE INVENTION

The present invention is an entirely new type of button which is attached to an article by positive mechanical means without the sewing thread required by conventional buttons. Hence, the problem of the buttons dropping off the article due to breakage of the thread after long usage is avoided. In addition, the button in accordance with the present invention can be readily attached to and detached from the article. Therefore, the machine washing and ironing of the article may be facilitated by the easy removal of the buttons beforehand. Furthermore, if desired, buttons of one ornamental style or design can be readily replaced by buttons of a different ornamental style or design without requiring the use of scissors, sewing needle and sewing thread.

The button in accordance with the present invention is composed of an auxiliary button head adapted to be "buttoned" in an auxiliary buttonhole in one part of an article and a main button head adapted to be buttoned in a main buttonhole in another part of the article and a connecting stud linking the auxiliary button head with the main button head.

The main button head, the auxiliary button head and the connecting stud can be made in one integral piece or as separate elements joined together through suitable means. Alternatively, any two adjacent elements can be made in one integral piece with the remaining element made as a separate element and joined to the integral piece elements by appropriate means.

Additionally, to the top of the main button head, a decorative piece can be fixed through appropriate means.

Since the button of the present invention is not attached by thread, it cannot drop off an article as a result of thread breakage and is therefore referred to herein as the "drop-off-proof" button. In normal use, the button of the present invention will stay on to the article permanently. Even under brutal jerking and yanking, the drop-off-proof button will stand up better than a conventional button. For machine washing and ironing, the drop-off-proof button can be readily removed before washing and ironing and readily reattached afterwards, thus facilitating those operations. The drop-off-proof button is particularly suited to the changing of the style or design of buttons on a garment for purposes of fashion. The construction of the drop-off-proof button is very simple and can therefore be produced at very low cost.

DESCRIPTION OF THE DRAWINGS

An illustrative embodiment of a drop-off-proof button in accordance with this invention will be described in more detail in conjunction with the accompanying drawings, wherein.

For convenience of reference, the corresponding structural elements in the various drawings are designated by the same reference numerals throughout the drawings.

DETAILED DESCRIPTION

Figure 1:
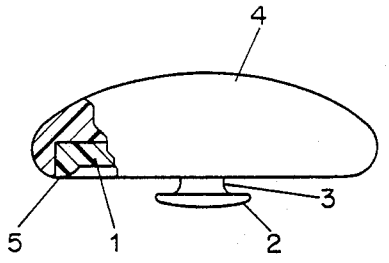
FIG. 1 is a partially sectional view of such a drop-off-proof button.
Figure 2:
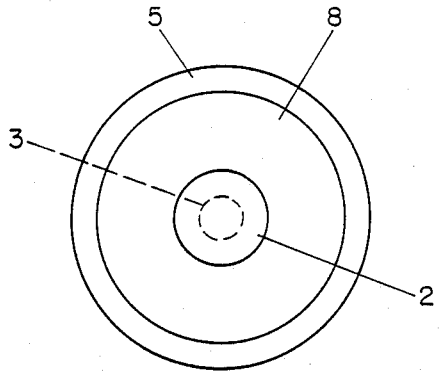
FIG. 2 is the bottom view of the drop-off-proof button of FIG. 1.
Figure 3:
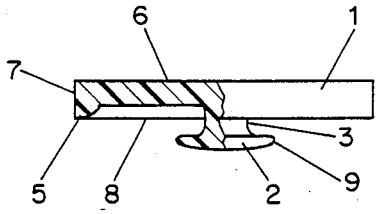
FIG. 3 is a partially sectional view of such a drop-off-proof button without a decorative piece attached.

Referring to FIGS. 1–3, a basic form of a drop-off-proof button in accordance with this invention comprises one main button head 1, one auxiliary button head 2 and one connecting stud 3 linking the main button head 1 with the auxiliary button head 2. At the underside of the periphery of the main button head 1, there is a bulging flange 5 with a height of about the thickness of the buttonhole. To the top 6 and periphery 7 of the main button head 1, a decorative piece 4 can be attached through any of a variety of means, such as, interference fit, bonding, riveting, welding or screwing if the decorative piece is to be removed readily so that it can be quickly changed. The decorative piece 4 can be made in different configurations, sizes, thicknesses and ornamental designs. The decorative piece 4 can be made of a variety of materials, such as plexiglas, plastics, sheet metal or metallic bar stock. To adapt the drop-off-proof button to mass production, no critical requirement is imposed on the main button head 1, the auxiliary button head 2 and the connecting link 3, as their respective configurations may be varied to suit fabrication requirements. Of course, if no decorative piece 4 is to be attached to the main button head 1, the main button head 1 can also be made into different shapes or designs. The auxiliary button head 2 can also be of any size or shape, but generally, it is round. The length of the connecting stud 3, that is, the distance between the underside 8 of the main button head 1 and the topside 9 of the auxiliary button head 2, is advantageously about the total thickness of the edges of the two buttonholes in the fabric of the clothing being buttoned up or only slightly longer to keep the two flaps being buttoned close together.

For the sake of simplifying tooling and reducing production cost, the main button head 1, the auxiliary button head 2 and the connecting stud 3 are preferably made in one piece. However, they can also be made of separate pieces of elements and be put together through any of a variety of possible means, such as bonding, welding, riveting or screwing. It is also possible for the main button head 1 and the connecting stud 3 to be made in once piece and have the auxiliary button head 2 attached to the free end of the connecting stud 3 by appropriate means. Alternatively, the auxiliary button head 2 and the connecting stud 3 can be made in one piece with the main button head 1 attached to the free end of the connecting stud 3 by appropriate means. The material for making the drop-off-proof buttons can be chosen from a wide variety, including plastics, sheet metal, metallic bar stocks, bakelite and plexiglas. The manufacturing process for making the drop-off-proof button can either be injection molding, punch pressing or lathe turning.

Figure 4:
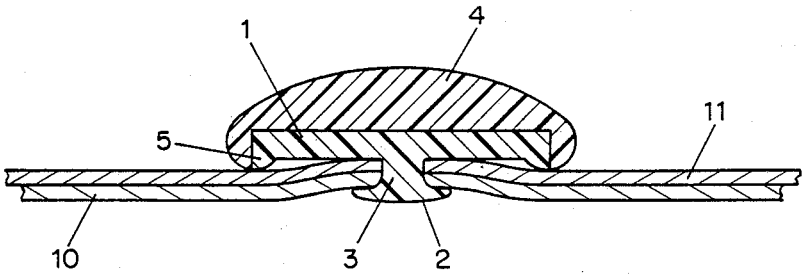
FIG. 4 is a sectional view showing a drop-off-proof button in the state of being attached to one flap of the clothing and buttoned up to the other flap of the clothing.

The manner of using the drop-off-proof button is as follows. Referring to FIG. 4, two conventional buttonholes with sizes matching the sizes of the auxiliary button head 2 and the main button head 1 are provided in the flaps 10 and 11 of the clothing, respectively. In attaching the drop-off-proof button to the clothing, the auxiliary button head 2 of the drop-off-proof button is inserted into the buttonhole on lower flap 10 of the clothing. Thus accomplished, the clothing can be buttoned up by buttoning the main button head 1 into the buttonhole on upper flap 11 of the clothing. The drop-off-proof button can readily be removed from the clothing by reversing the procedure as described above.

It is to be understood that the drop-off-proof button of the present invention may be used on articles other than clothing, such as bags of various types made of cloth or other pliable materials. Furthermore, such buttons need not be used for joining two parts of an article but may be attached to an article purely for decorative purposes.

I claim:

1. A drop-off-proof button configured so as to not be thread sewn to an article of clothing and capable of being buttoned into and unbuttoned from a button head and a connecting stud; the main button head having a basically flat lower surface with a peripheral flange projecting towards the auxiliary buttonhead; the stud configured so as to connect the inner surfaces of the main and auxiliary button heads and to intersect the main and auxiliary heads at approximately 90 degrees; the stud further configured in a cylindrical shape; wherein the diameter of the main head is significantly larger than the diameter of the auxiliary head which is significantly larger than the diameter of the stud; the auxiliary head having a flat inner surface, a convexed downward lower surface and a relatively thin perimeter.

2. A drop-off-proof button according to claim 1, wherein the main button head, auxiliary button head and connecting stud are one piece.

3. A drop-off-proof button according to claim 1, wherein the main head and the connecting stud are made in one piece, to which the auxiliary button head is fixed by appropriate means.

4. A drop-off-proof button according to claim 3, wherein said appropriate means for fixing the main button head, the auxiliary button head and the connecting stud with one another include bonding, welding, riveting or screwing.

5. A drop-off-proof button according to claim 1, wherein the auxiliary button head and connecting stud are one piece, to which the main button head is fixed by appropriate means.

6. A drop-off-proof button according to claim 5, wherein the appropriate means for fixing the main button head, the auxiliary button head and the connecting stud with one another include bonding, welding, riveting or screwing.

7. A drop-off-proof button according to claim 1, wherein the connecting stud is fixed to the main button head by appropriate means, and the other end is fixed to the auxiliary button head by appropriate means.

8. A drop-off-proof button according to claim 7, wherein the appropriate means for fixing the main button head, the auxiliary button head and the connecting stud with one another include bonding, welding, riveting or screwing.

9. A drop-off-proof button according to claim 1, further including a decorative piece fixed to the main button head by appropriate means, including interference fit, bonding, riveting, welding or screwing.

10. A drop-off-proof button according to claim 1, wherein the length of the connecting stud is approximately equal to the total thickness of the clothing being buttoned.

* * * * *

UNITED STATES PATENT AND TRADEMARK OFFICE

CERTIFICATE OF CORRECTION

PATENT NO. : 4,907,320

DATED : March 13, 1990

INVENTOR(S) : Ting Miao

It is certified that error appears in the above-identified patent and that said Letters Patent is hereby corrected as shown below:

First page, following Item 22, insert
-- [30] Foreign Application Priority Data
January 14, 1987 China 87200383 --;
second column, fifth line, "1059590" should read
-- 1050590 --. Col. 3, line 49, after "from a" insert
-- buttonhole comprising an auxiliary button head; a
main --.

Signed and Sealed this

Ninth Day of July, 1991

*Attest:*

*Attesting Officer*

HARRY F. MANBECK, JR.

*Commissioner of Patents and Trademarks*